US006340009B1

(12) United States Patent
Boecking

(10) Patent No.: US 6,340,009 B1
(45) Date of Patent: Jan. 22, 2002

(54) INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,512

(22) PCT Filed: Aug. 11, 1999

(86) PCT No.: PCT/DE99/02510

§ 371 Date: Sep. 18, 2000

§ 102(e) Date: Sep. 18, 2000

(87) PCT Pub. No.: WO00/09866

PCT Pub. Date: Feb. 24, 2000

(30) Foreign Application Priority Data

Aug. 14, 1998 (DE) ..... 198 36 902

(51) Int. Cl.[7] ..... F01L 1/34

(52) U.S. Cl. ..... 123/90.15; 123/90.11; 123/90.12; 123/90.14

(58) Field of Search ..... 123/90.15, 90.11, 123/90.12, 90.14, 90.55, 446, 188.9; 251/129.06, 129.15, 129.21, 129.01

(56) References Cited

U.S. PATENT DOCUMENTS 4,388,908 A * 6/1983 Babitzka et al. ..... 123/446
4,466,390 A * 8/1984 Babitzka et al. ..... 123/90.12
4,622,942 A * 11/1986 Nozaki et al. ..... 123/446
5,002,022 A * 3/1991 Perr ..... 123/90.12
5,114,116 A * 5/1992 Muller et al. ..... 251/129.15
5,275,205 A * 1/1994 Bauer ..... 251/129.06
5,810,255 A * 9/1998 Itoh et al. ..... 251/129.06

FOREIGN PATENT DOCUMENTS

DE 3739775 A1 * 6/1988
DE 4209590 C1 * 5/1993
DE 19739539 A1 * 3/1999

* cited by examiner

*Primary Examiner*—Teresa Walberg
*Assistant Examiner*—Fadi H. Dakbour
(74) *Attorney, Agent, or Firm*—Ronald E. Greigg

(57) ABSTRACT

An internal combustion engine having at least one combustion chamber in which the chamber has at least two hydraulically or pneumatically actuatable valves that are each guided in a respective valve guide. The engine includes an inlet valve for admitting fuel or a fuel-air mixture into the combustion chamber before the combustion event and an outlet valve for exhausting the combustion exhaust gases from the combustion chamber after the combustion event. In such internal combustion engines, in order to shorten the response times of the valve control, the valves are fixed relative to the valve guide by means of a respective electrically actuatable fastening element.

17 Claims, 3 Drawing Sheets

INTERNAL COMBUSTION ENGINE

The present invention relates to an internal combustion engine having at least one combustion chamber, which chamber has at least two hydraulically or pneumatically actuatable valves that are each guided in a respective valve guide, namely an inlet valve for admitting fuel or a fuel-air mixture into the combustion chamber before the combustion event and an outlet valve for exhausting the combustion exhaust gases from the combustion chamber after the combustion event. The present invention also relates to a hydraulically or pneumatically actuatable valve guided in a valve guide. Finally, the present invention also relates to a method for limiting the stroke stop of a hydraulically or pneumatically actuatable valve guided in a valve guide.

PRIOR ART

Such internal combustion engines with hydraulically or pneumatically actuatable valves are known from the prior art. Compared to internal combustion engines with camshaft-actuated valves, they have the advantage that the valves can be triggered individually, independently of one another. As a result of the variable valve triggering, the noise production can be reduced, and the fuel consumption and exhaust gas performance of the engines can be improved markedly.

In these known internal combustion engines, however, it proves to be disadvantageous that the hydraulically or pneumatically triggerable valves have quite long response times. It takes approximately 300–400 ms until a valve that is in the process of opening reacts to a corresponding command of a control unit, terminates its opening motion, and comes to a stop in a desired valve position. With the aid of this kind of triggering of the valves, the stroke stop of the valves can for instance be varied. Because of the long response times, the triggering of the valves can be done with only limited precision, and it is moreover very complicated to include the hydraulic or pneumatic valve triggering in a closed-loop control.

It is therefore an object of the present invention to design and refine an internal combustion engine of the type defined at the outset in such a way that the response times of the valve control are shortened decisively.

To attain this object, the invention, taking as its point of departure the internal combustion engine as defined at the outset, proposes that the valves can each be fixed relative to the valve guide by means of a respective electrically actuatable fastening element.

By the use of the electrically actuatable fastening elements, the valves can be fixed in an arbitrary valve position relative to the valve guide. The response times of these electrically actuatable fastening elements are very short. With their aid, the reaction times of the hydraulically or pneumatically triggerable valves can be shortened decisively, in that simultaneously with the hydraulic or pneumatic assembly, the electrically actuatable fastening elements, which respond faster, are triggered as well. The activation of the fastening elements, for instance during the opening of a valve, causes a brief blocking of the hydraulic or pneumatic valve actuation assembly. The fast-response fastening elements, which fix the valve relative to the valve guide, then act counter to the hydraulic or pneumatic assembly, which attempts to continue the opening of the valve until this assembly, too, responds to the control signal for terminating the opening motion. Yet the blocking does not affect the hydraulic or pneumatic valve actuation assembly, since the valve actuating means (a liquid or a gas) are compressible and thus have a cushioning effect.

According to the invention, it has been discovered that the long response times of the hydraulically or pneumatically triggerable valves occur because of the high volumetric flows inside the valve actuation assembly. By using additional electrically actuatable fastening elements with substantially shorter response times, the reaction times of the valves of the internal combustion engine of the invention can be shortened decisively.

Advantageously, the fastening element is embodied as a clamping element. A clamping element can clamp the valve firmly relative to the valve guide by means of frictional engagement. As a result, once a desired valve opening position is reached, there is not an abrupt or sudden cessation of a valve opening motion. Instead, the valve is braked relative to the valve guide during the opening motion.

In an advantageous refinement of the invention, it is proposed that the valve shaft has a stroke stop, which upon opening of the valve meets the clamping element, and that the clamping element in the relaxed state is axially displaceable by the stroke stop in a clamping element guide relative to the valve guide, counter to the force of a spring element. The clamping element is a variable stroke stop, by which the valve stroke can be variably set. The clamping element can be displaced inside the valve guide in the relaxed state. The displacement of the clamping element in the direction of shorter valve strokes is done by means of a spring element, which acts between the valve guide and the clamping element. The displacement of the clamping element in the direction of longer strokes by the stroke stop of the valve shaft during the opening motion of the valve. Once the desired valve position is reached, the clamping element is activated, and the valve is fixed in its position at that instant relative to the valve guide.

In another advantageous refinement of the internal combustion engine of the invention, it is proposed that the valve shaft has a stroke stop, which upon opening of the valve meets the clamping element, and that the clamping element in the relaxed state is axially displaceable hydraulically or pneumatically in a clamping element guide relative to the valve guide, counter to the force of a spring element. In this embodiment as well, the clamping element allows a variable stroke to be set. The clamping element can be displaced inside the valve guide, in the relaxed state. Displacing the clamping element in the direction of shorter valve strokes is done by means of a spring element, which acts between the valve guide and the clamping element. Displacing the clamping element in the direction of longer strokes is effected by means of a hydraulic or pneumatic adjusting assembly. By means of the adjusting assembly, the clamping element can be moved into an arbitrary valve stroke limiting position, independently of any valve opening motion. Once the desired valve stroke position is reached, the clamping element is activated and fixed relative to the valve guide. The valve can now be opened only widely enough that the stroke stop meets the clamping element.

Several exemplary embodiments have been described above in which the clamping element is displaceable relative to the valve guide in the relaxed state and is fixed relative to the valve guide in the activated state. However, it is also conceivable for the clamping element to be fixed relative to the valve guide in the relaxed state and to be displaceable in the activated state.

Preferably in internal combustion engines with at least two inlet valves and/or at least two outlet valves per combustion chamber, the clamping elements of at least two of the inlet valves and/or at least two of the outlet valves are connected to one another via a bridge element. In this way, in multiple-valve internal combustion engines, the clamping elements of each of the inlet valves and outlet valves of a combustion chamber can be controlled jointly via the valve assembly. Advantageously, the clamping element has at least one piezoelectric actuator for actuating the clamping element. Piezoelectric actuators have the advantage of having especially short response times and of bringing about firm clamping of the clamping element relative to the valve guide within about 20 ms after a suitable control signal. This means that the response times of the valves of the internal combustion engine of the invention can be shortened by a factor of approximately 10 to 20.

In an advantageous refinement of the invention, the clamping element is embodied as a clamping ring, which on its circumference has a gap in which the at least one piezoelectric actuator is disposed, in such a manner that an excitation of the piezoelectric actuator leads to an increase in the circumference of the clamping ring and to a fixation of the clamping ring in the clamping element guide. In the relaxed state of the piezoelectric actuators, the clamping ring has an outside diameter that is smaller than the inside diameter of the valve guide; the clamping ring is axially displaceable inside the valve guide. In the excited state of the piezoelectric actuators, the piezoelectric actuators expand and widen the gap in the clamping ring, thus increasing its outside diameter so much that the outside face of the clamping ring rests on the inside face of the valve guide. As a result of the force of the excited piezoelectric actuator that continues to be operative, the clamping ring is fixed relative to the valve guide by frictional engagement.

However, it is also conceivable to dispose the at least one piezoelectric actuator in the gap of the clamping ring in such a way that the clamping ring rests with its outside circumference on the inside circumference of the valve guide in the relaxed state of the piezoelectric actuators and is hindered from an axial motion inside the valve guide by frictional engagement. In this case, an excitation of the piezoelectric actuators would lead to a decrease in the circumference of the clamping ring, thus allowing the clamping ring to be axially displaced.

In another advantageous refinement of the present invention, it is proposed that the clamping element is embodied as a clamping ring, which on its circumference has a gap in which the two spaced-apart clamping jaws are disposed, in such a manner that an increasing in the spacing between the clamping jaws leads to an increase in the circumference of the clamping ring and to a fixation of the clamping ring in the clamping element guide, and at least the piezoelectric actuator is disposed in the spacing between the clamping jaws in such a way that an excitation of the piezoelectric actuator leads to an increase in the spacing between the clamping jaws. In the relaxed state of the piezoelectric actuators, the clamping ring has an outside diameter that is smaller than the inside diameter of the valve guide; the clamping ring is axially displaceable inside the valve guide. In the excited state of the piezoelectric actuators, the piezoelectric actuators expand and increase the spacing between the clamping jaws. The clamping jaws that have been pressed farther apart widen the gap in the clamping ring, thus increasing its outside diameter to such an extent that the outside face of the clamping ring rests on the inside face of the valve guide. Because of the force of the excited piezoelectric actuator that continues to be operative, the clamping ring is fixed relative to the valve guide by frictional engagement.

It is also conceivable to provide a plurality of gaps in one clamping ring. In such a case, piezoelectric actuators or clamping jaws with piezoelectric actuators could be disposed in at least some of the gaps.

The clamping jaws can be secured to the clamping ring in the gap. In this embodiment, the clamping jaws and the piezoelectric actuators move axially together with the clamping ring inside the clamping element guide.

Alternatively, according to an especially advantageous refinement of the invention, it is proposed that the clamping jaws are axially fixed relative to the clamping element guide. This has the advantage that the clamping jaws and the piezoelectric actuators do not move together with the clamping ring axially inside the clamping element guide.

In a preferred refinement of the internal combustion engine of the invention, it is proposed that the clamping element is embodied as a clamping ring, upon which at least one clamping jaw, which is axially fixed relative to the clamping element guide, acts, which are displaceable radially inward by means of the at least one piezoelectric actuator in such a way that they act from outside upon the clamping ring. Two fundamental versions of this refinement are conceivable.

In the first version, the clamping ring has an outside diameter that is smaller than the inside diameter of the valve guide. The clamping ring is axially displaceable inside the clamping element guide in the relaxed state of the piezoelectric actuators. In the excited state of the piezoelectric actuators, the clamping jaws are displaced radially inward, until the inside faces of the clamping jaws rest on the outside face of the clamping ring. As a result of the force, which continues to be operative, of the piezoelectric actuators, the clamping ring is hindered from axial motion inside the clamping element guide by the clamping jaws, by means of frictional engagement. The clamping ring is fixed relative to the valve guide in the clamping element guide. For static reasons, it makes sense for the clamping ring in this version not to have a gap on the circumference.

In the second version, the clamping ring is not axially displaceable inside the clamping element guide in the relaxed state of the piezoelectric actuators, because the clamping ring has an outside diameter that is greater than the inside diameter of the clamping element guide. The outside face of the clamping ring rests on the inside face of the clamping element guide, and the clamping ring is fixed on the clamping element guide by frictional engagement. In the excited state of the piezoelectric actuators, the clamping jaws are displaced radially inward until the inside faces of the clamping jaws rest on the outside face of the clamping ring. By the force, which continues to be operative, of the piezoelectric actuators, the clamping jaws act on the clamping ring in such a way that the outside circumference of the clamping ring is decreased. The clamping ring suitably has a gap on its circumference, and the width of the gap is decreased by the force of the clamping jaws. The clamping ring now has an outside diameter that is less than the inside diameter of the clamping element guide, and it is axially displaceable inside the clamping element guide. In order to fix the clamping ring in a desired valve end stroke position relative to the clamping element guide, the piezoelectric actuators are relaxed again.

The present invention also relates to a hydraulically or pneumatically actuatable valve guided in a valve guide.

In order to shorten the response times of such valves decisively, it is proposed according to the invention that the valve can be fixed relative to the valve guide by means of an electrically actuatable fastening element.

Advantageously, the valve is embodied as an inlet valve for admitting fuel or a fuel-air mixture into a combustion chamber of an internal combustion engine, or as an outlet valve for exhausting combustion exhaust gases from the combustion chamber. Particularly when used as an inlet valve or outlet valve of an internal combustion engine, the particular advantages of the valves of the invention are especially valuable.

The present invention finally also relates to a method for triggering a hydraulically or pneumatically actuatable valve guided in a valve guide, and in particular for limiting the stroke stop.

To make it possible to trigger the valve with as little delay as possible, it is proposed according to the invention that the valve is fixed relative to the valve guide by means of an electrically actuatable fastening element.

Advantageously, the fastening element is embodied as a clamping element that is axially displaceable in a clamping element guide and that is fixed relative to the valve guide in the clamping element guide by means of a piezoelectric actuator.

BRIEF DESCRIPTION OF THE DRAWINGS

Three preferred exemplary embodiments of the present invention will be described in further detail below in conjunction with the drawing. Shown are.

DETAILED DESCRIPTION

Figure 1A:
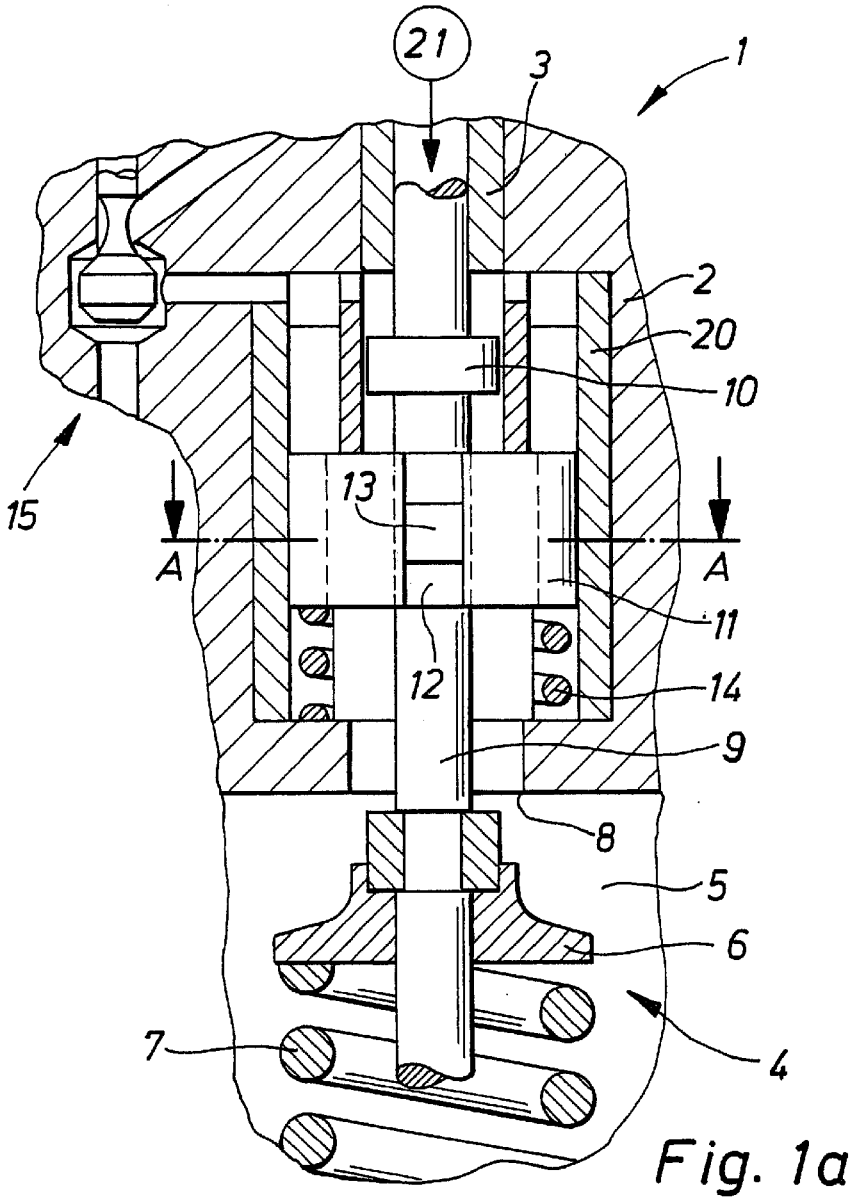
FIG. 1*a*, an internal combustion engine of the invention in a detail showing a fastening element in a first version from the front, partly in section.

In FIG. 1*a*, an internal combustion engine 1 of the invention is shown in a detail. A valve guide 3 is embodied in a cylinder head 2 of the engine 1, and a valve 4 is guided in the valve guide. The valve 4 closes or opens the access to a combustion chamber 5 of the engine 1. For closing the access, a valve plate 6 of the valve 4 is pressed by a valve spring 7 against a valve seat 8, which is embodied at the access to the combustion chamber 5. The valve 4 is actuated by means of a hydraulic or pneumatic valve actuating assembly 21.

A valve shaft 9 of the valve 4 is axially displaceably supported in the valve guide 3. The valve shaft 9 has a stroke stop 10. The valve 4 is embodied as an inlet valve for admitting fuel or a fuel-air mixture into the combustion chamber 5 before the combustion event. However, the valve 4 could also be embodied as an outlet valve for exhausting the combustion exhaust gases from the combustion chamber 5 after the combustion event, without changing the design of the valve 4 in any way.

A fastening element embodied as a clamping ring 11 is disposed inside a clamping element guide 20. The clamping ring 11 has a gap 12 on its circumference, in which gap a piezoelectric actuator 13 is disposed in such a way that an excitation of the piezoelectric actuator 13 leads to an increase in the width of the gap 12 and thus to an increase in the circumference of the clamping ring 11.

The clamping ring 11 is axially displaceable inside the clamping element guide 20 when the piezoelectric actuator 13 is relaxed. The stroke stop 10 of the valve shaft 9 meets the clamping ring 11 in a valve opening motion. By axial displacement of the clamping ring 11 inside the clamping element guide 20, the valve stroke of the valve 4 can accordingly be set. In the relaxed state of the piezoelectric actuator 13, the clamping ring 11 can be displaced axially inside the clamping element guide 20 in the direction of a longer valve stroke, counter to the force of a spring element 14, by means of a hydraulic adjusting assembly 15. By triggering the hydraulic adjusting assembly 15, the desired valve stroke terminal position can be set by means of the clamping ring 11. In the desired valve stroke terminal position, the piezoelectric actuator 13 is then activated, and the clamping ring 11 is fixed in the clamping element guide 20 relative to the valve guide 3.

In the ensuing drawing figures, the reference numerals are used for the same components.

Figure 1B:
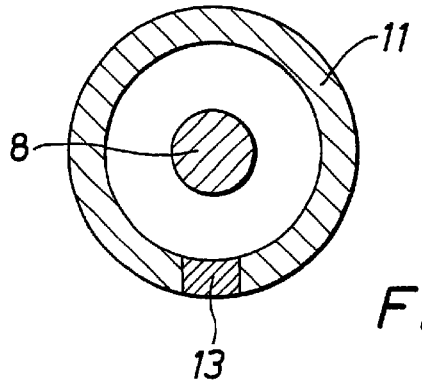
FIG. 1*b*, the fastening element of FIG. 1*a* in plan view, in a section taken along the line A—A.

In FIG. 1*b*, the clamping ring 11 of FIG. 1*a* is shown in plan view, in a section taken along the line A—A.

Figure 2A:
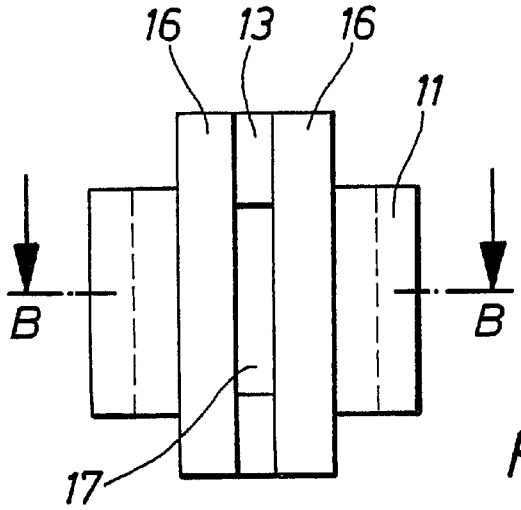
FIG. 2*a*, a second version of a fastening element, seen from the front.

In FIG. 2*a*, the fastening element in a second version is shown. The fastening element in the second version also has a clamping ring 11 with a gap 12 located on the circumference of the fastening element.

In the gap 12, two spaced-apart clamping jaws 16 are disposed in such a way that an increase in the spacing 17 between the clamping jaws 16 leads to an increase in the circumference of the clamping ring 11. Two piezoelectric actuators 13 are disposed in the spacing 17 between the clamping jaws 16 in such a way that an excitation of the piezoelectric actuators 13 leads to an increase in the spacing 17 between the clamping jaws 16. Thus by an activation of the piezoelectric actuators 13, the circumference of the clamping ring 11 can be increased, and the clamping ring can be fixed in the clamping element guide 20 relative to the valve guide 3. The clamping jaws 16 are axially fixed in the cylinder head 2 relative to the clamping element guide 20. To set a desired valve stroke terminal position, the clamping ring 11 is axially displaced inside the clamping element guide 3 relative to the clamping jaws 16 by means of the hydraulic adjusting assembly 15 or by means of the spring element 14. Once the desired valve stroke terminal position is reached, the piezoelectric actuators 13 are activated, and the clamping ring 11 is fixed in the clamping element guide 20 relative to the valve guide 3.

Figure 2B:
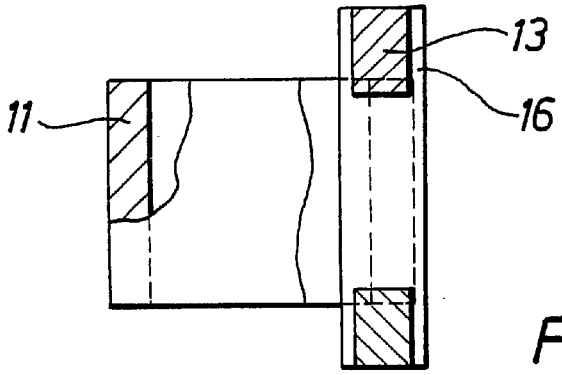
FIG. 2*b*, a side view of the fastening element of FIG. 2*a*, partly in section.
Figure 2C:
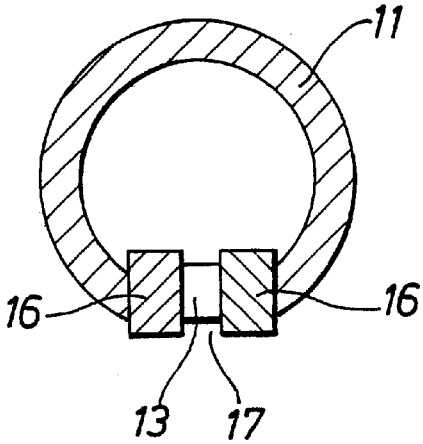
FIG. 2*c*, the fastening element of FIGS. 2*a* and 2*b* in plan view and in a section taken along the line B—B.

In FIG. 2*b*, the fastening element of FIG. 2*a* is shown in a side view. FIG. 2*c* shows the fastening element of FIGS. 2*a* and 2*b* in plan view, in a section taken along the line B—B.

Figure 3A:
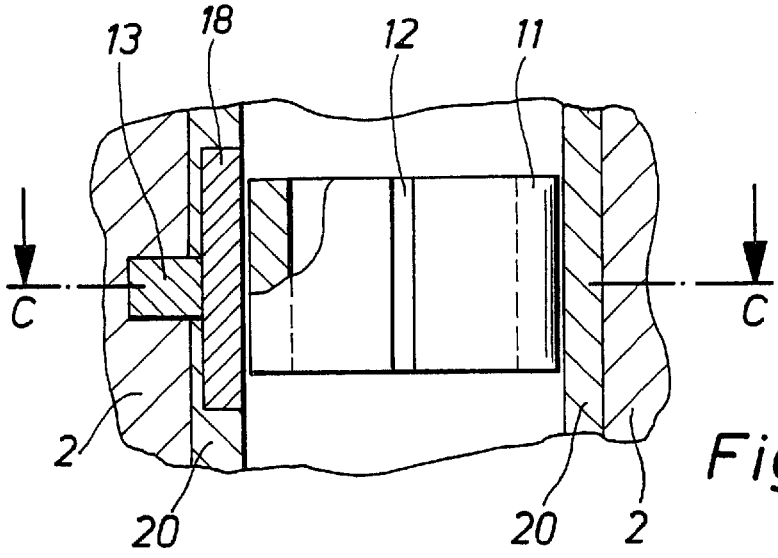
FIG. 3*a*, a fastening element in a third version seen from the front, partly in section.

In FIG. 3*a*, a fastening element in a third version is shown. The fastening element again has a clamping ring 11, which in the relaxed state is axially displaceably supported inside the clamping element guide 20. A clamping jaw 18 is embodied in the inner circumference of the clamping element guide 20 and is displaceable radially inward by means of a piezoelectric actuator 13 in such a way that the clamping jaw acts from outside upon the clamping ring 11 and secures against axial displacement inside the clamping element guide 20. In this embodiment as well, the setting of a desired valve stroke terminal position is effected by an axial displacement of the clamping ring 11 by means of the hydraulic adjusting assembly 15, counter to the force of the spring element 14.

Figure 3B:
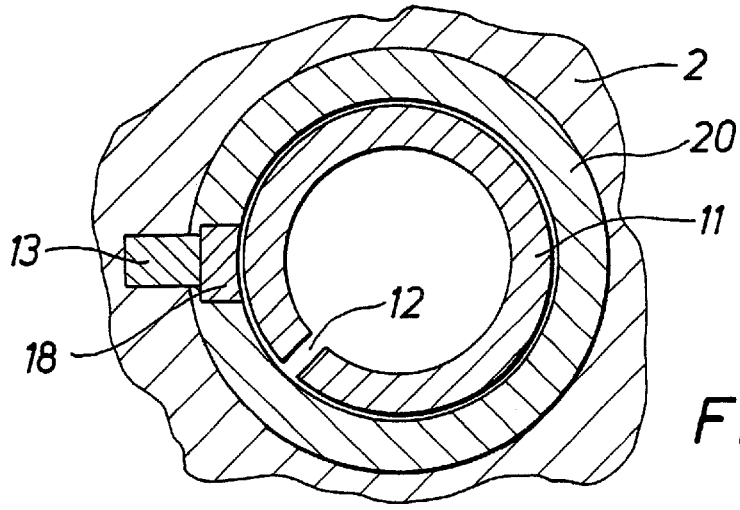
FIG. 3*b* the fastening element of FIG. 3*a* in plan view, in a section taken along the line C—C.

In FIG. 3*b*, the fastening element of FIG. 3*a* is shown in plan view, in a section taken along the line C—C.

In internal combustion engines 1 that have at least two inlet valves and/or at least two outlet valves, the clamping elements 11 of each of a plurality of the inlet valves or outlet valves can be connected to one another via a bridge element 19.

Figure 4A:
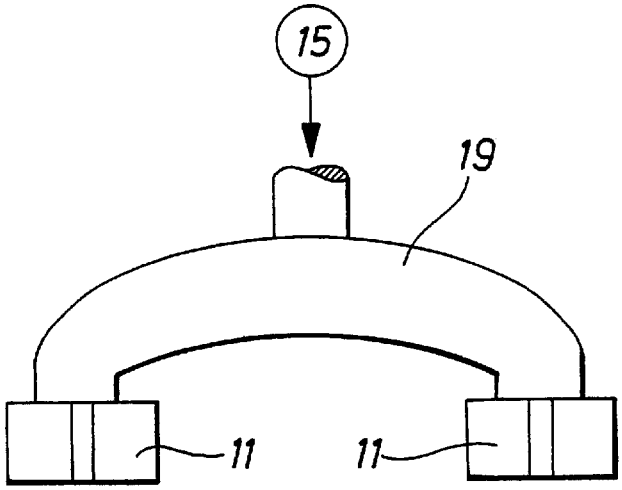
FIG. 4*a* a bridge element for connecting the clamping element of two valves, seen from the front.
Figure 4B:
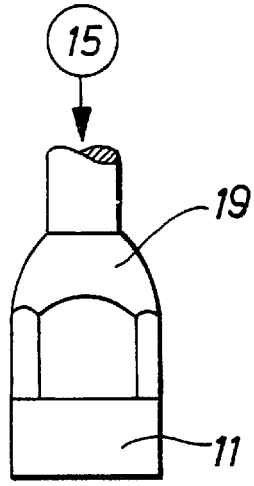
FIG. 4*b* the bridge element of FIG. 4*a* in a side view.

In FIGS. 4*a* and 4*b*, one such bridge element 19 is shown, by which the clamping elements 11 of two valves 4 are connected to one another.

The foregoing relates to a preferred exemplary embodiments of the invention, it being understood that other variants and embodiments thereof are possible within the spirit and scope of the invention, the latter being defined by the appended claims.

I claim:

1. An internal combustion engine comprising at least one combustion chamber (5), the combustion chamber has at least two hydraulically or pneumatically actuatable valves (4) that are each guided in a respective valve guide (3), an inlet valve for admitting fuel or a fuel-air mixture into the combustion chamber (5) before the combustion event and an outlet valve for exhausting the combustion exhaust gases from the combustion chamber (5) after the combustion event, the valves (4) are fixed relative to the valve guide (3) by means of an electrically actuatable clamping element.

2. The engine according to claim 1, in which a valve shaft (9) has a stroke stop (10), which upon opening of the valve (4) meets the clamping element, and that the clamping element in a relaxed state is axially displaceable by the stroke stop (10) in a clamping element guide (20) relative to the valve guide (3), counter to the force of a spring element (14).

3. The engine according to claim 2, having at least two inlet valves and/or at least two outlet valves per combustion chamber (5), in which the clamping elements of at least two of the inlet valves and/or at least two of the outlet valves are connected to one another via a bridge element (19).

4. The engine according to claim 3, in which the clamping element has at least one piezoelectric actuator (13) for actuating the clamping element.

5. The engine according to claim 2, in which the clamping element has at least one piezoelectric actuator (13) for actuating the clamping element.

6. The engine according to claim 1, in which a valve shaft (9) has a stroke stop (10), which upon opening of the valve (4) meets the clamping element, and that the clamping element in the relaxed state is axially displaceable hydraulically or pneumatically in a clamping element guide (20) relative to the valve guide (3), counter to the force of a spring element (14).

7. The engine according to claim 6, having at least two inlet valves and/or at least two outlet valves per combustion chamber (5), in which the clamping elements of at least two of the inlet valves and/or at least two of the outlet valves are connected to one another via a bridge element (19).

8. The engine according to claim 6, in which the clamping element has at least one piezoelectric actuator (13) for actuating the clamping element.

9. The engine according to claim 1, in which the clamping element has at least one piezoelectric actuator (13) for actuating the clamping element.

10. The engine according to claim 9, in which the clamping element is embodied as a clamping ring (11), which on a circumference has a gap (12) in which the at least one piezoelectric actuator (13) is disposed, in such a manner that an excitation of the piezoelectric actuator (13) leads to an increase in the circumference of the clamping ring (11) and to a fixation of the clamping ring (11) in the clamping element guide (20).

11. The engine according to claim 9, in which the clamping element is embodied as a clamping ring (11), which on a circumference has a gap (12) in which the two spaced-apart clamping jaws (16) are disposed, in such a manner that an increasing in the spacing (17) between the clamping jaws (16) leads to an increase in the circumference of the clamping ring (11) and to a fixation of the clamping ring (11) in the clamping element guide (20), and at least the piezoelectric actuator (13) is disposed in the spacing (17) between the clamping jaws (16) in such a way that an excitation of the piezoelectric actuator (13) leads to an increase in the spacing (17) between the clamping jaws (16).

12. The engine according to claim 11, in which the clamping jaws (16) are axially fixed relative to the clamping element guide (20).

13. The engine according to claim 9, in which the clamping element is embodied as a clamping ring, upon which at least one clamping jaw (18), which is axially fixed relative to the clamping element guide (20) acts, which are displaceable radially inward by means of the at least one piezoelectric actuator (13) in such a way that they act from outside upon the clamping ring (11).

14. An internal combustion engine as set forth in claim 1 which comprises a hydraulically or pneumatically actuatable valve (4) guided in a valve guide (3), in which the valve (4) can be fixed relative to the valve guide (3) by means of an electrically actuatable clamping element.

15. An internal combustion engine according to claim 14, in which the valve (4) is embodied as an inlet valve for admitting fuel or a fuel-air mixture into a combustion chamber (5) of an internal combustion engine, or as an outlet valve for exhausting combustion exhaust gases from the combustion chamber (5).

16. A method of operating an internal combustion engine comprising at least one combustion chamber (5), in which the combustion chamber has at least two hydraulically or pneumatically actuatable valves (4) that are each guided in a respective valve guide (3), an inlet valve for admitting fuel or a fuel-air mixture into the combustion chamber (5) before the combustion event and an outlet valve for exhausting the combustion exhaust gases from the combustion chamber (5) after the combustion event, the method comprising limiting a stroke stop of the hydraulically or pneumatically actuatable valves (4) that are guided in the valve guide (3) and fixing the valves (4) relative to the valve guide (3) by means of an electrically actuatable clamping element.

17. The method according to claim 16, in that the clamping element can be moved axially in a clamp element guide (20) and fixing the clamping element in the clamp element guide (20) in relation to the valve guide (3) by means of a piezoelectric acutator (13).

* * * * *